US007430824B1

(12) United States Patent
Ngan

(10) Patent No.: US 7,430,824 B1
(45) Date of Patent: Oct. 7, 2008

(54) MAGNETIC WALL MOUNTABLE ARTICLE IN-POCKET DISPLAY FRAME

(76) Inventor: Chi Lung Ngan, 5 Bradford Rd., Edison, NJ (US) 08820

( * ) Notice: Subject to any disclaimer, the term of this patent is extended or adjusted under 35 U.S.C. 154(b) by 0 days.

(21) Appl. No.: 11/819,362

(22) Filed: Jun. 27, 2007

(51) Int. Cl.
*G09F 3/18* (2006.01)

(52) U.S. Cl. ..... 40/661.01; 40/654.01; 40/600; 40/711

(58) Field of Classification Search ..... 40/661.01, 40/654.01, 600, 775, 776, 711, 649, 611.09
See application file for complete search history.

(56) References Cited

U.S. PATENT DOCUMENTS 3,319,369 A * 5/1967 Severson ..... 40/654.01
3,698,111 A * 10/1972 Smith ..... 40/661.01
3,958,690 A * 5/1976 Gee, Sr. ..... 206/232
4,310,978 A * 1/1982 Stern ..... 40/600
5,274,937 A 1/1994 Birnbaum
5,924,624 A 7/1999 Martin
6,024,277 A * 2/2000 Martin ..... 229/71
6,256,913 B1 * 7/2001 Pellegri ..... 40/654.01
6,282,826 B1 * 9/2001 Richards ..... 40/654.01
6,578,304 B1 * 6/2003 Lytle ..... 40/711
6,684,544 B1 * 2/2004 Buettell ..... 40/661.01
6,701,654 B2 * 3/2004 Rappaport et al. ..... 40/776
6,807,761 B2 * 10/2004 Rappaport et al. ..... 40/776
6,862,827 B2 * 3/2005 Gregory ..... 40/661
2002/0133992 A1 * 9/2002 Wu ..... 40/661.01
2003/0121194 A1 7/2003 Rappaport
2003/0233778 A1 12/2003 Gross

* cited by examiner

*Primary Examiner*—William L. Miller
(74) *Attorney, Agent, or Firm*—Shlesinger, Arkwright & Garvey LLP.

(57) ABSTRACT

A magnetic wall mounted article in-pocket display frame having at least one window and having an upper portion based from a pocket positioned behind the window with a horizontal hinged portion having a magnet for securing the article display to a magnet attracting surface.

9 Claims, 4 Drawing Sheets

MAGNETIC WALL MOUNTABLE ARTICLE IN-POCKET DISPLAY FRAME

FIELD OF THE INVENTION

This invention relates to a magnetic wall mountable article in-pocket display frame having a magnetic flap extending upwardly from a horizontal hinge for positioning the article in-pocket display frame on a magnet attracting surface.

BACKGROUND OF THE INVENTION

Document holders such as Smith U.S. Pat. No. 3,698,111 had been used for many years.

Magnetic document holders such as Birnbaum U.S. Pat. No. 5,274,937, Martin U.S. Pat. No. 5,924,624, Rappaport publication no. US 2003/0121194 and Gross publication no. US 2003/0233778 show devices which can be mounted on a magnetically attracting surface such as a refrigerator or metallic door or the like. These devices are limited to the extent that the display portion is not flexible about the magnetic holding means requiring the observer to bend down when the devices are positioned at a low level.

OBJECTS AND SUMMARY OF THE INVENTION

It is an object of this invention to provide a magnetic wall mountable article in-pocket display frame in which the display portion of the frame can be pivoted upwardly for a visual inspection of the article while the upper portion of the frame is still magnetically held to the magnet attracting surface.

Another object of this invention is to provide a magnetic wall mountable in-pocket display frame which is attractive, durable and readily positioned on a magnet attracting surface.

A further object of this invention is to provide a magnetic wall mountable article in-pocket display frame which is easy and inexpensive to manufacture.

Still another object of this invention is to provide a magnetic wall mountable article in-pocket display frame having a readily accessible pocket which securely holds an article to be displayed.

In summary this invention pertains to a magnetic wall mountable article in-pocket display frame having a portion which is moveable to allow visual inspection without removing the other portion from the magnetic attracting surface. These and other objects will be apparent from the following description and drawings which are as follows:

BRIEF DESCRIPTION OF THE DRAWINGS

FIGS. 1-5

As shown in FIG. 1, the display frame F displaying an article A such as a picture or calendar or the like is mounted on a wall W such as the vertical surface of magnet attracting door, cabinet or refrigerator or the like. A frame F comprises a front panel 2 and rear panel 4. The front panel 2 as shown in the figures includes multiple windows 6 and 8 but may include 1 or more windows as desired depending upon the length of the frame F.

As shown in FIG. 3, the front panel 2 includes an outer dress cover 10 which may be of decorative plastic, foil or the like. The outer dress cover 10 supports a first stiff support based 12 and a second stiff support base 14. The first and second stiff support bases may be of cardboard or calandered material of plastic, paper or the like. The outer dress cover includes fold over edges 16, 18, 20 and 22 which enclose the first and second stiff support bases 12 and 14. The outer dress cover 10 and the first stiff support base 12 are cut-out to form the windows 6 and 8. The second stiff support base 14 includes at least one magnet M. A magnet M may be of a strip plastic type magnet or a small circular magnet or the like with sufficient power to maintain the article F on a magnetic attracting surface wall W.

Figures 1, 2:
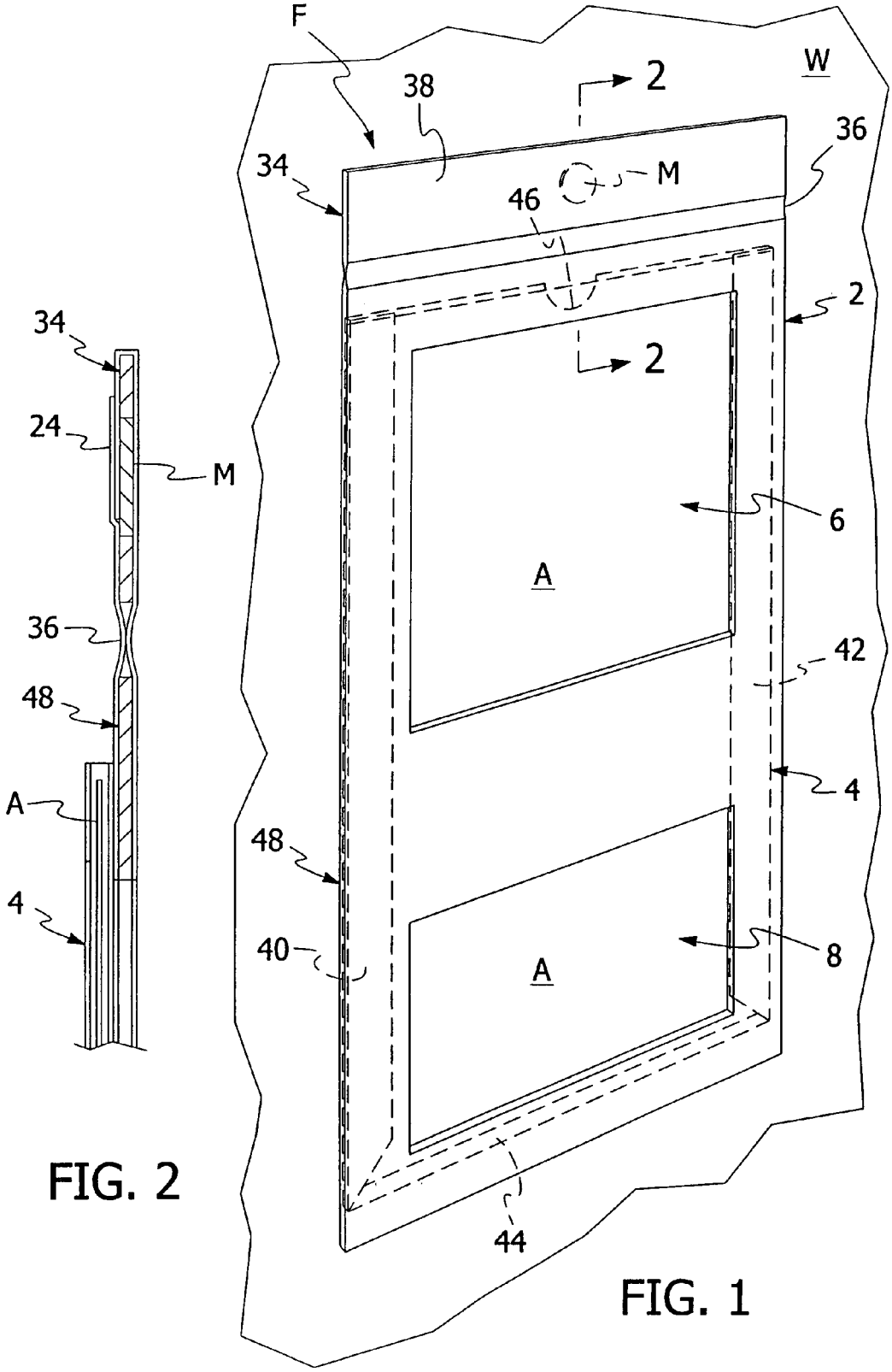
FIG. 1 is a perspective view of the invention positioned on a magnetic attracting surface and showing portions in phantom lines.
FIG. 2 is an enlarged cross sectional fragmentary view taken along the lines 2-2 of FIG. 1 and viewed in the direction of the arrows.
Figure 3:
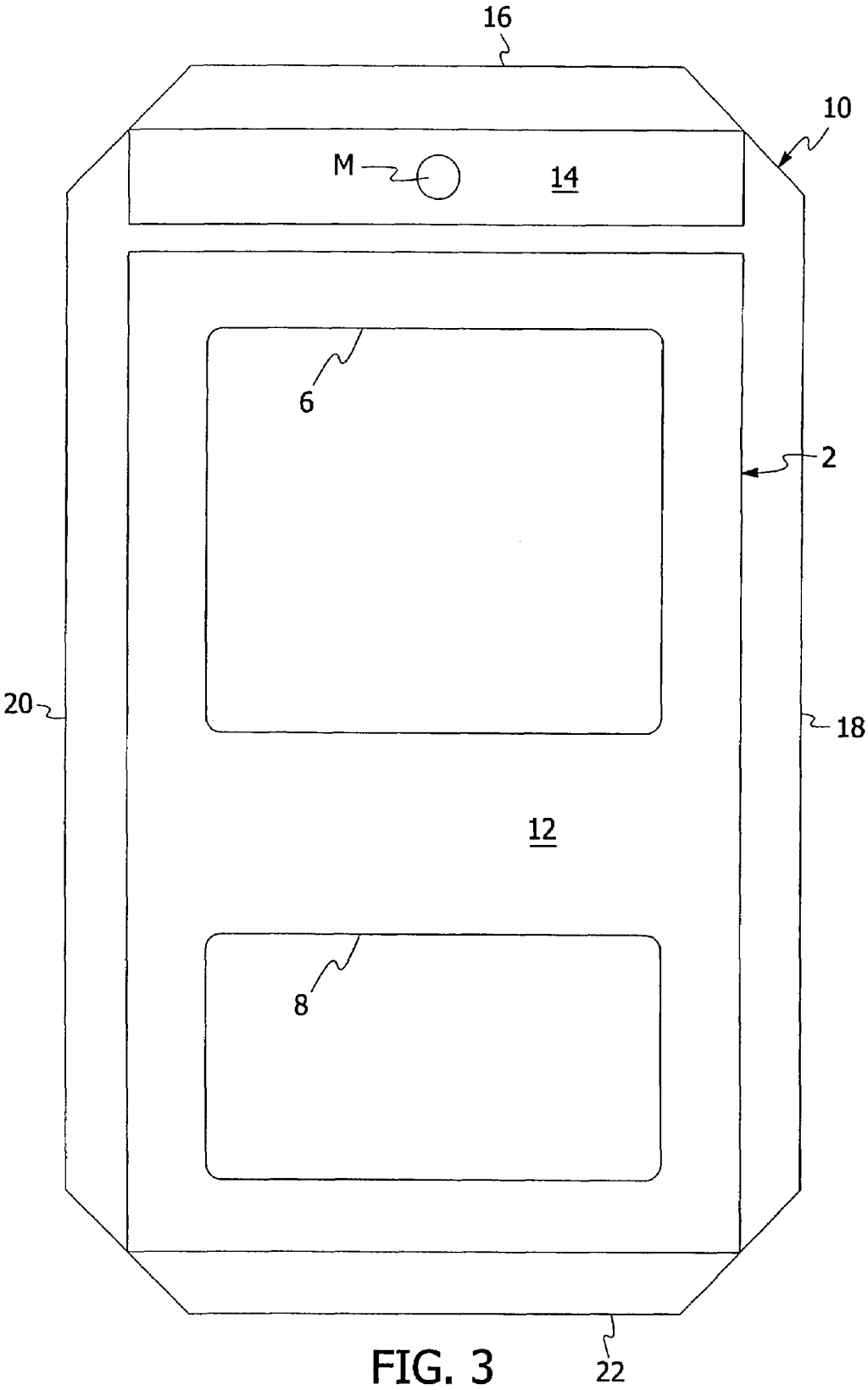
FIG. 3 is a top plan view of the front panel with the first and second stiff support bases positioned on the outer dress cover prior to sealing.
Figure 4:
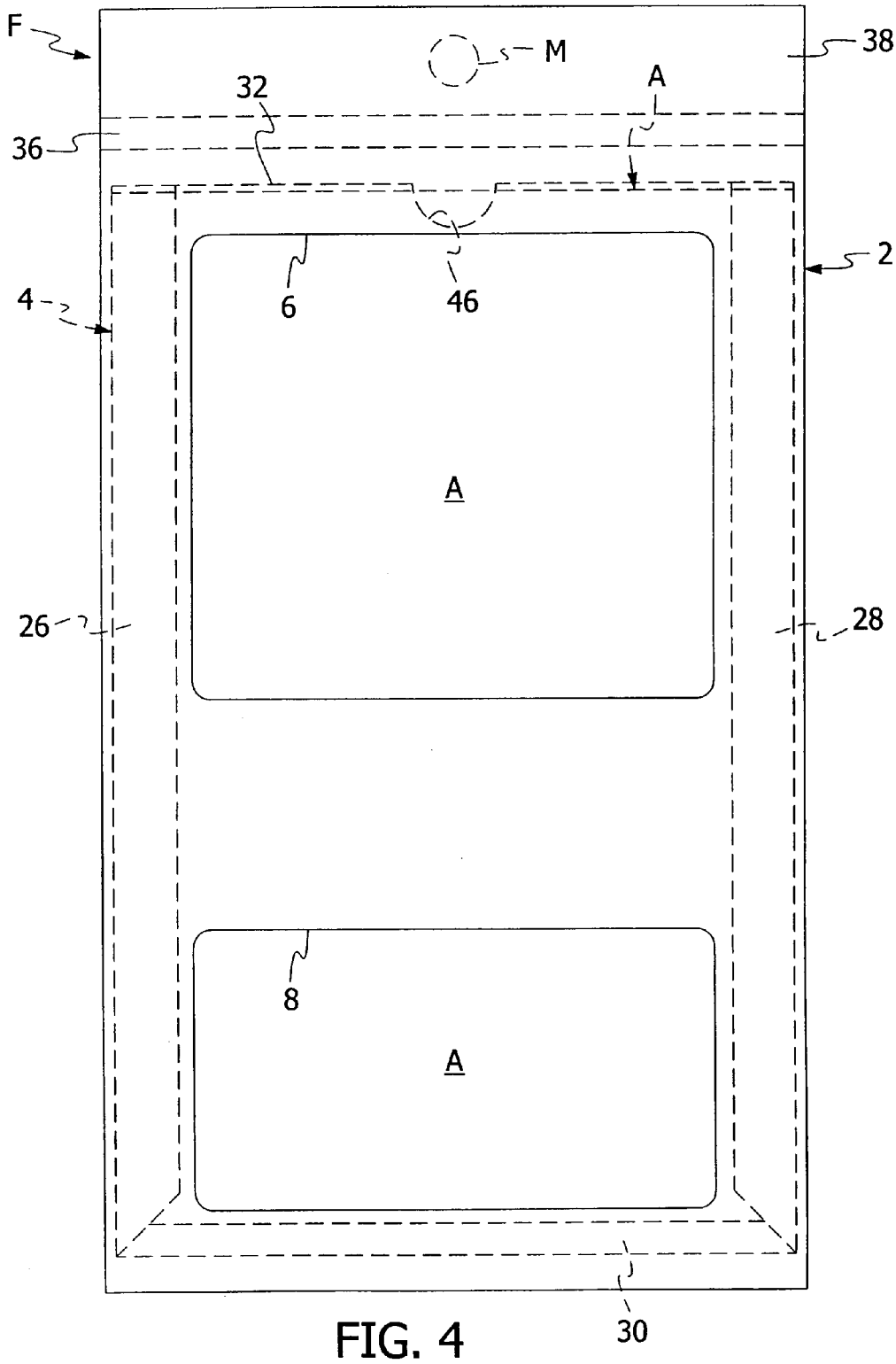
FIG. 4 is a front top plan view of the invention and having portions shown in phantom lines.
Figure 5:
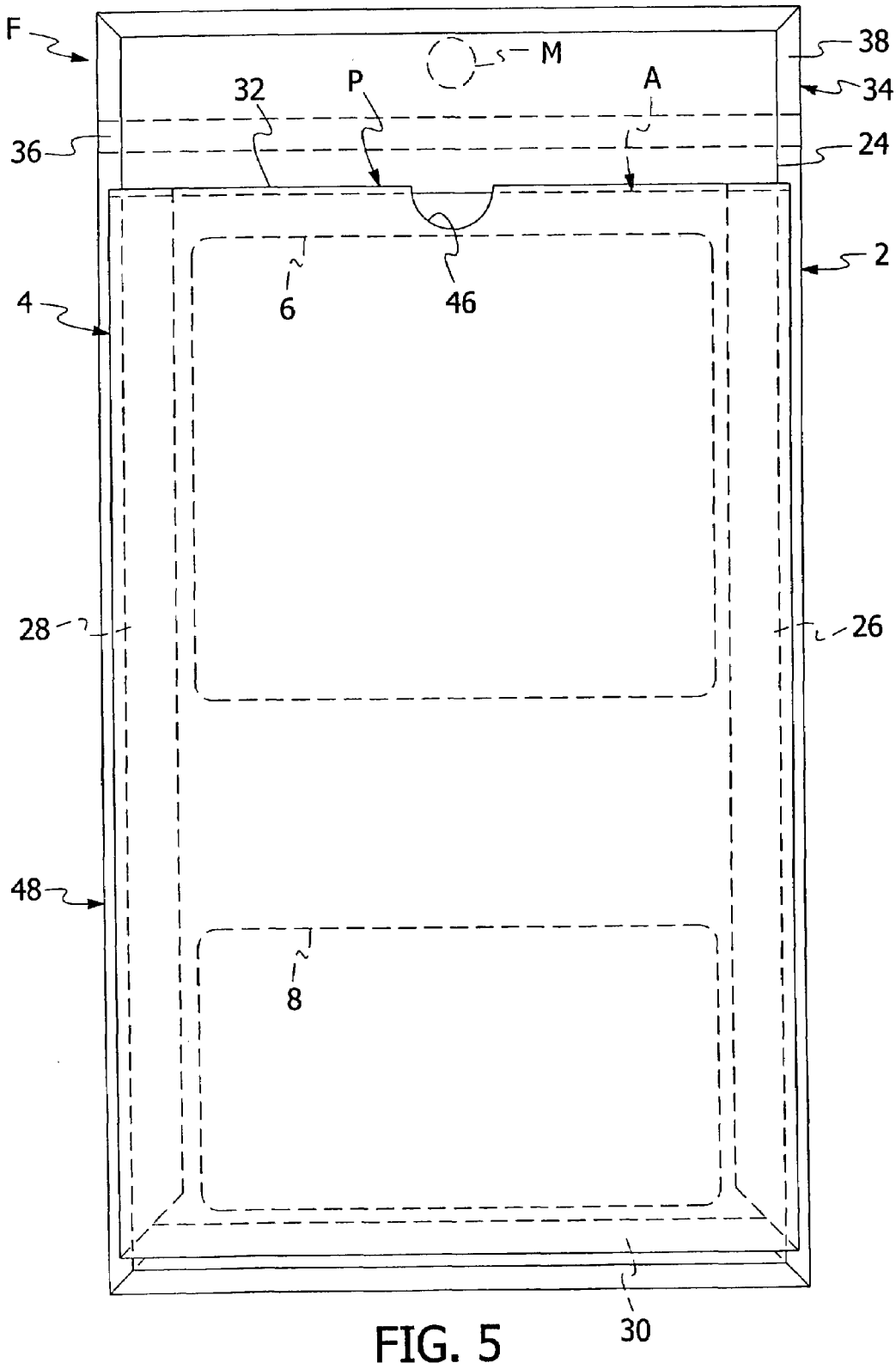
FIG. 5 is a rear top plan view of the invention and having portions shown in phantom lines.

The front panel 2 may include an inner cosmetic cover 24 as best shown in FIG. 5 which extends the full length and width of the back surface of the front panel 2 and which is provided with cut-outs for the windows 6 and 8. As best shown in FIG. 5, rear panel 4 is shorter than front panel 2 and is secured to the front panel 2 at side edges 26 and 28 and bottom edge 30 leaving the top edge 32 of the rear panel open thus forming a pocket P for insertion of display articles A such as pictures, calendars and the like. The rear panel 4 being shorter than the front panel 2, provides an upper portion 34 on the front panel 2. A horizontal hinge 36 is positioned in the front panel 2 above the pocket P separating the first stiff support base 12 from the second stiff support base 14 thereby providing a flap 38 which pivots on the horizontal hinge 36. The flap 38 encompasses the magnet M.

The rear panel 4 has fold over side edges 40, 42, and bottom edge 44 secured to the front panel 2. The rear panel 4 covers and encompasses the windows 6 and 8. The top edge of the rear panel 4 includes a thumb recess 46 for ease in removing the article A displayed in the pocket P.

It is to be noted that the frame F when positioned on the wall W permits flexing of the lower portion 48 of the panel 2 relative to the upper portion 34 of panel 2 to permit ease in viewing of the material in the frame F without pulling the frame from the surface of the refrigerator, door or the like.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A magnetic wall mountable article in-pocket display frame comprising:

a) a front panel having at least one window;

b) a rear panel secured to said front panel and circumscribing and framing said at least one window;

c) said front and rear panels having top, bottom and side wall edges;

d) said rear panel bottom and side wall edges secured to said front panel bottom and side wall edges and forming a pocket between said front and rear panels for viewing an article display;

e) said front panel having an upper portion extending beyond said rear panel's top wall edge;

f) said rear panel top wall edge being unsecured and forming with said top panel a pocket opening for said pocket;

g) said upper portion including a horizontal hinge positioned between said top panel top wall edge and said rear panel top wall edge;

h) said upper portion including a flap extending from and pivoting on said horizontal hinge; and i) said flap having at least one magnet for mounting said article display frame to a magnet attracting wall.

2. A magnetic wall mountable article in-pocket display frame as in claim 1, and wherein:

a) said front panel includes a first stiff support base, an outer dress cover for said first stiff support base and an inner cosmetic cover for said first stiff support base.

3. A magnetic wall mountable article in-pocket display frame as in claim 2, and wherein:

a) said flap includes a second stiff support base separated from said first stiff support base.

4. A magnetic wall mountable article in-pocket display frame as in claim 3, and wherein:

a) said first and second stiff support bases are cardboard.

5. A magnetic wall mountable article in-pocket display frame as in claim 4, and wherein:

a) said at least one magnet is positioned in said second stiff support base and under said outer dress cover and said inner cosmetic cover.

6. A magnetic wall mountable article in-pocket frame as in claim 2, and wherein:

a) said outer dress cover is a plastic film.

7. A magnetic wall mountable article in-pocket display frame as in claim 3, and wherein:

a) said at least one magnet is positioned in said second stiff support base and under said outer dress cover and said inner cosmetic cover.

8. A magnetic wall mountable article in-pocket display frame as in claim 1, and wherein:

a) said rear panel top wall edge includes a thumbhold.

9. A magnetic wall mountable article in-pocket display frame as in claim 1, and wherein:

a) said rear panel is a stiff calendared board.

* * * * *